United States Patent [19]

Chauvy

[11] 4,105,493

[45] Aug. 8, 1978

[54] PRODUCTION OF SHAVING FOIL

[75] Inventor: Jean-Daniel Chauvy, Chaumont, Switzerland

[73] Assignee: The Gillette Company, Boston, Mass.

[21] Appl. No.: 822,968

[22] Filed: Aug. 8, 1977

Related U.S. Application Data

[63] Continuation of Ser. No. 699,040, Jun. 23, 1976, abandoned.

[30] Foreign Application Priority Data

Jul. 5, 1975 [GB] United Kingdom ..... 28426/75

[51] Int. Cl.[2] ..... C23F 1/02

[52] U.S. Cl. ..... 156/644; 96/36; 156/651; 156/661

[58] Field of Search ..... 156/644, 661, 650, 651; 96/36, 36.1

[56] References Cited

U.S. PATENT DOCUMENTS

| | | | |
|---|---|---|---|
| 2,750,524 | 6/1956 | Braham | 96/36.1 |
| 3,498,891 | 3/1970 | Futterer | 204/24 |
| 3,577,852 | 5/1971 | Futterer | 30/43.92 |
| 3,580,755 | 5/1971 | Kidd et al. | 156/650 |
| 3,653,900 | 4/1972 | Black | 96/36.1 |
| 3,655,528 | 4/1972 | Futterer | 204/24 |
| 3,655,529 | 4/1972 | Futterer | 204/11 |
| 3,666,462 | 5/1972 | Kaplan | 96/36.1 |
| 3,676,914 | 7/1972 | Fiore | 96/36.1 |
| 3,679,500 | 7/1972 | Kubo et al. | 156/661 |
| 3,695,927 | 10/1972 | Futterer | 204/11 |
| 3,929,532 | 12/1975 | Kuzminski | 96/36.1 |
| 4,013,498 | 3/1977 | Frantzen et al. | 156/650 |
| 4,069,085 | 1/1978 | Buysman et al. | 156/661 |

FOREIGN PATENT DOCUMENTS

| | | |
|---|---|---|
| 845,832 | 8/1960 | United Kingdom. |
| 1,189,718 | 4/1970 | United Kingdom. |

OTHER PUBLICATIONS

Chemical Milling with Kodak Photosensitive Resist, Kodak Publication, 1968, pp. 1–39.

*Primary Examiner*—David Klein
*Assistant Examiner*—Jerome W. Massie
*Attorney, Agent, or Firm*—Richard A. Wise; Oistein J. Bratlie; Donald E. Mahoney

[57] ABSTRACT

The invention concerns a method for producing foils for dry shavers.

The method of the invention includes forming a layer of photosensitive material on each side of a metal plate, exposing each side to light to produce a pattern of exposed and unexposed areas, corresponding to perforations at one side and recesses in the backs of the bars of the foil on the other side, etching each side, them removing photosensitive material from the front side and carrying out further etching until the foil is completely perforated.

The invention is especially suitable for forming foils for battery operated dry shavers.

8 Claims, 4 Drawing Figures

PRODUCTION OF SHAVING FOIL

This is a Continuation, of application Ser. No. 699,040, filed June 23, 1976, now abandoned.

FIELD OF THE INVENTION

This invention concerns a method of producing perforated foils for dry shavers.

The cutting head of a dry shaver conventionally comprises a perforated stationary outer shear foil and an inner movable cutter contacting the rear face of the shear foil. The cutter can either comprise a plurality of separate blades or it can itself be made from a perforated foil.

Our copending Application No. 699,041, filed June 23, 1976, now abandoned provides a shearing foil for a dry shaver, made from a sheet of metal or alloy, having perforations extending through the sheet with bars between the perforations, the bars being dished in transverse cross-sectional profile, the base of the dished profile being substantially flat and of uniform thickness ($t$), and the edges of the dished profile extending at an obtuse angle to the base to terminate with coplanar faces disposed parallel to the base, said face having a width ($w$) in the transverse direction which is not greater than ($t$).

STATEMENT OF PRIOR ART

Various forms of foil have been proposed in the literature, or employed in practice. For instance, British Pat. Specification No. 845,832 describes a foil whose thickness (from front to rear surfaces) immediately adjacent to the apertures exceeds the thickness at those portions between apertures.

Heretofore, a variety of methods has been proposed and employed for producing shaving foils. For instance, electrodeposition techniques have been proposed in U.S. Pat. Nos. 3,498,891; 3,655,528; 3,655,529; and 3,695,297. Stamping techniques have also been described, for instance in U.S. Pat. No. 3,216,286. British Patent No. 1,056,038 provides a method involving coating a flat stainless steel plate with a photoresist, exposing through a mask with the desired apertures, removing the unhardened parts of the resist to bare the steel, bending the plate to the desired shape and etching through the steel and removing the hardened parts by burning off to obtain the shear plates. Preferably, the shear plate is hardened by heating to 1,020° C, cooled rapidly, immersed in liquid air and tempered at 200° C.

An earlier method described in British Patent Specification No. 845,832 involves: etching a sheet by a chemical or electrochemical process, so as to produce apertures surrounded by rims which project from the inner surface of the plate which is contacted by the cutting member. Apertures in a resist on the outer side are in groups, and resist on the inner side forms a pattern of islands each corresponding to such a group. Etching is carried out until less than half the thickness of metal has been removed, then stopped, and resist applied over all the inner side including the etched depressions, then etching is re-started so as to etch holes through from the outer side, and continued until each group of apertures merges into a single hole surrounded on the inner side by a crenate rim.

There has, however, been a continued search for new methods of producing foils.

OBJECT OF THE INVENTION

The object of the present invention is to provide a novel method of producing a perforated foil for a dry shaver.

STATEMENT OF THE INVENTION

The present invention provides a method of producing a shearing foil for a dry shaver from a sheet of metal, said foil having a front face and a back face, and exhibiting perforations extending through the sheet from said front face to said back face with bars between the perforations, the bars being dished in transverse cross-sectional profile, the recessed base of the dished profile being substantially flat and of uniform thickness, and the edges of the dished profile extending at an angle to the base to terminate with coplanar faces disposed parallel to the base, which method comprises applying a layer of a photosensitive material to each face of the sheet of metal, exposing the front face to radiation through a mask having a hole pattern corresponding to the desired perforations of the shaving foil, exposing the back face to radiation through a mask having a pattern corresponding to the recessed base of the dished profile, developing the photosensitive material in order to generate a respective pattern of unprotected regions on each face of the metal sheet, etching said unprotected regions of the front face and the back face, removing the photosensitive layer from the front face foil, carrying out a further etching of the front face until a predetermined quantity of metal is removed and the ridges of the bars are smoothly rounded off, and finally removing the remaining masking material.

DESCRIPTION OF DRAWINGS

The invention will be more particularly described with reference to the accompanying drawings in which.

PARTICULAR DESCRIPTION OF THE INVENTION

Figure 1:
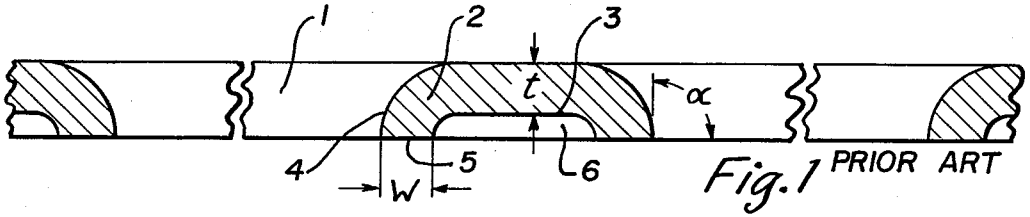
Fig. 1 PRIOR ART
FIG. 1 is a cross-section through a bar on a foil of conventional construction.
Figure 2:
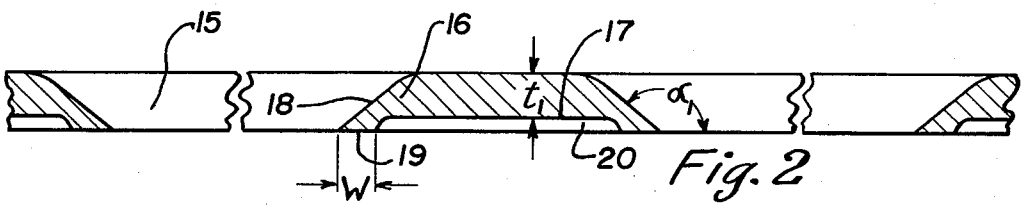
FIG. 2 is a cross-section through a bar on a foil according to our above-mentioned copending Application.

Referring now to FIGS. 1 and 2, a foil has apertures 1, 15 and bars 2, 16 between the apertures 1, 15. The bars 2, 16 are dished in cross-sectional profile, with a substantially flat base 3, 17 of thickness t, $_1$and edges 4, 18 extending at an angle $\alpha$ to the base 3, 17. The edges 4, 18 terminate in faces 5, 19 which are coplanar and parallel to the base 3, 17, and have a width w, $w_1$. The bars 2, 16 therefore, have recessed portions 6, 20.

In accordance with the conventional construction shown in FIG. 1, $w$ is greater than $t$, and the angle $\alpha_1$ is substantially a right angle.

In accordance with the invention of our copending Application shown in FIG. 2, $w_1$ is not greater than $t_1$. In other words, $w_1$ can be substantially the same as $t_1$, or it can be less than $t_1$.

The material from which the foils are made is a single metal or alloy (e.g. steel).

The use of a single material in the construction of the foils according to the invention makes it possible to employ the advantageous etching technique according to the present invention. This technique will be described with reference to FIGS. 3 and 4 of the accompanying drawings.

Figure 3:
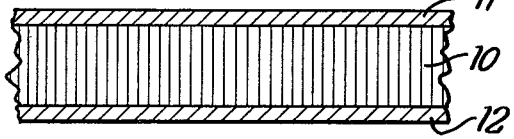
FIGS. 3 and 4 are cross-sections illustrating two stages during the method according to the invention.
Figure 4:
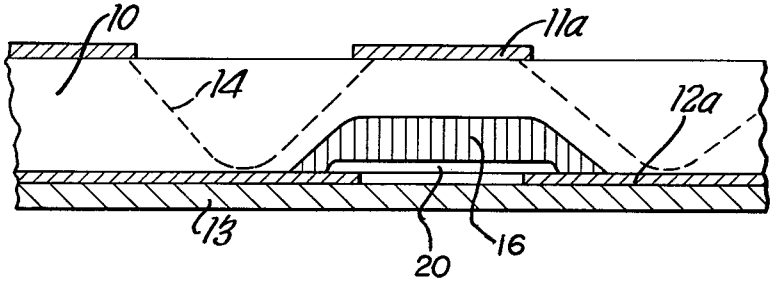

In accordance with this method, a strip 10 of a suitable metal, e.g. laminated steel, is cleaned to remove grease and other contaminants from its surfaces, and is then provided by dip-coating with a layer of a suitable negative or positive photoresist on each surface. A preferred negative photoresist is Waycoat-450 sold by the Philip A. Hunt Chemical Corporation. Another suitable negative photoresist is KMER of Kodak, and a suitable positive photoresist is AZ 111 of Shipley Chemicals Ltd. The layers of photoresist 11 and 12 are hardened by baking. The strip 10 at this stage is shown in FIG. 3. Both layers are then exposed to ultraviolet radiation through appropriate masks, such as exposed and developed photographic film having transparent areas and opaque areas. In the case of a negative photoresist, the mask adjacent the layer 11 will have opaque areas in correspondence to the desired position of the apertures 15, whilst the mask adjacent the layer 12 will have opaque areas in corespondence to the recessed portions 20. Care must of course be taken to ensure that the masks are precisely registered, so that the positions of the apertures 15 and recessed portions 20 in the finished product will be accurate. After the exposure, the photoresist is developed and baked. The strip 10 will have on one side masking areas 11*a* and on the other side, masking areas 12*a* (see FIG. 4).

The face of the workpiece provided with the masking areas 12*a* (which will provide the back face of the foil) is then subjected to spray etching, in order to form the recessed portions 20. Once these have been etched to the correct depth, the workpiece is rinsed and dried, and the newly-etched face is protected by a protective film 13, for instance, of adhesive tape.

The face of the workpiece provided with masking areas 11*a* (which will provide the front face of the foil) is then spray etched, the etching being halted when the metal has been eaten away to position 14, shortly before the apertures are completely formed.

After rinsing, the masking areas 11*a* are removed, leaving the areas 12*a* and protective film 13 in place. Alternatively, both the masking areas 11*a* and 12*a* and the protective film 13 are removed, and a further protective film, for instance a layer of shellac, is applied over the face bearing the recessed portions. Further etching of the unprotected face (i.e. the front face) removes more metal and smoothly rounds off the edges of the bars 16, leaving a foil with aperture 1, 15 and bars 2, 16. Finally, after an optional chemical polishing step, the protective film is removed, and the finished foil is rinsed and dried.

The following Example illustrates one preferred manner in which a shaving foil according to the invention can be made.

EXAMPLE

A steel strip is subjected to an intensive cleaning involving firstly ultrasonic cleaning in a chlorinated solvent such as trichloroethylene, or preferably trichloroethane, at room temperature, followed by blow drying. This is followed by alkaline cleaning in a hot degreasing salt solution, with agitation, followed by rinsing with water. A suitable degreasing salt for this purpose is Metex TS 40 A (from MacDermid) which can be conveniently employed at a temperature of about 40° C. The plate is then subjected to electrolytic cleaning in a cold alkaline cyanide-free solution, e.g. Oxyprep 285 of Oxy Metal Finishing Co., followed by water-rinsing. After neutralizing with dilute 18% hydrochloric acid, washing with water, dionized water and isopropyl alcohol, the plate is finally dried in a vapour of a chlorinated solvent, such as trichloroethane.

Both faces of the plate are now provided with a layer of Waycoat 450 photoresist by dip-coating in Waycoat 450 thinned with Waycoat PF thinner to a viscosity providing the required thickness of photoresist. After optional airdrying of the coated plate, the photoresist is provided with a pre-exposure baking, for 10 minutes at 95°–100° C in a convection oven, or for 2 minutes at 350° C in an infrared unit. The photoresist on each side of the plate is then exposed to ultraviolet light through masks made from exposed photographic film having transparent areas and opaque areas. On the side which will finally provide the front face of the foil, and which is provided with layer 11 (see FIG. 3) the transparent areas will correspond to areas 11*a* (see FIG. 4), and on the side which will finally provide the back face of the foil, and which is provided with layer 12, the transparent areas will correspond to areas 12*a*. Optimum exposure is achieved by holding 6 to 7 steps after exposure through a Stauffer 21 step sensitivity guide or a Kodak # 2 step wedge.

After exposure, development can be carried out by spraying and immersion. It involves contacting the exposed photoresist with Waycoat PF Developer, Waycoat PF Thinner, and water, followed by air drying. The developed photoresist is then baked for 10 minutes at 120° C in a convection oven or for 2 minutes at 350° C in an infra-red unit.

Etching is then carried out, advantageously using a double-sided spray-etching apparatus, for instance the apparatus sold by Chemcut Corporation. Etching can be carried out using Waycoat PF Etchant, but it is advantageous to employ a 48° Beaume solution of ferric chloride, heated to a temperature of 52° C.

The first etching stage is carried out for 20 to 40 seconds on the back face to provide the recessed portions 20 followed by rinsing with deionized water and blow-drying with nitrogen. A protective layer of adhesive cellulose acetate tape 13 is then applied. The second etching stage is then carried out on the front face to remove metal down to position 14. This involves etching for 100 to 140 seconds, followed by washing with deionized water and blow-drying with nitrogen.

The masking areas 11*a* are then removed using Kodak CP Stripper 13 LS, the recesses 20 and masking areas 12*a* being protected by the protective layer 13. A final etching is carried out on the front face using the same etching solution as before, at the same temperature as before. This final etching takes about 40 seconds, followed by washing with deionized water and blow drying with nitrogen.

A chemical polishing step can then be carried out using a polishing solution suitable for the metal of the strip 10. Suitable solutions are described for instance with Band ½ of "Handbuch der Galvanotechnik" by Dettner and Elze, Carl Hauser Verlag, Munchen.

Finally the protective layer 13 is removed and the remaining masking areas 12*a* are stripped off using Kodak LS 13 stripper. After a final washing with water and blow-drying with nitrogen, the manufacture of the foil is complete.

I claim:

1. A method of producing a shearing foil for a dry shaver from a sheet of metal, said foil having a front face and a back face, and exhibiting desired perforations extending through the sheet from said front face to said back face with bars between the perforations, the bars being dished in transverse cross-sectional profile to provide a substantially flat recessed base of substantially uniform thickness, the dished profile having edges extending at an angle to the base to terminate with substantially coplanar surfaces on the back face disposed substantially parallel to the base, which method comprises applying a layer of a photosensitive material to each face of the sheet of metal, exposing the photosensitive material on the front face to radiation through a mask having a hole pattern corresponding to the desired perforations of the shaving foil, exposing the photosensitive material on the back face to radiation through a mask having a pattern corresponding to the recessed base of the dished profile, developing the exposed photosensitive material on said faces in order to generate a respective pattern of unprotected regions on each face of the metal sheet, etching said unprotected regions of the front face, and of the back face, removing the photosensitive layer from only the front face, and carrying out a further etching of the front face until a predetermined quantity of metal is removed providing the bars with smoothly rounded ridges and edges extending at an obtuse angle to the base.

2. A method as claimed in claim 1, wherein the step of etching the unprotected regions of the front and back faces is performed by etching the back face first to provide the recessed base of the dished profile, and then etching the front face.

3. A method as claimed in claim 1 wherein the photosensitive material is a positive photoresist.

4. A method as claimed in claim 3, wherein the step of etching the unprotected regions of the front and back faces is performed by etching the back face first to provide the recessed base of the dished profile, and then etching the front face.

5. A method as claimed in claim 1, wherein the photosensitive material is a negative photoresist.

6. A method as claimed in claim 5, wherein the step of etching the unprotected regions of the front and back faces is performed by etching the back face first to provide the recessed base of the dished profile, and then etching the front face.

7. A method as claimed in claim 5, further comprising:

applying an additional masking layer to the back face after etching the recessed base of the dished profile and before removing the photoresist layer from the front face.

8. A method as claimed in claim 1, wherein the photoresist material is a positive photoresist.

* * * * *